US011931791B2

(12) United States Patent
Dohmen et al.

(10) Patent No.: US 11,931,791 B2
(45) Date of Patent: Mar. 19, 2024

(54) STITCHER

(71) Applicant: SMS group GmbH, Düsseldorf (DE)

(72) Inventors: Melanie Dohmen, Willich (DE); Manuel Bendler, Düsseldorf (DE)

(73) Assignee: SMS group GmbH, Düsseldorf (DE)

( * ) Notice: Subject to any disclaimer, the term of this patent is extended or adjusted under 35 U.S.C. 154(b) by 0 days.

(21) Appl. No.: 17/793,224

(22) PCT Filed: Jan. 14, 2021

(86) PCT No.: PCT/EP2021/050747
§ 371 (c)(1),
(2) Date: Jul. 15, 2022

(87) PCT Pub. No.: WO2021/144394
PCT Pub. Date: Jul. 22, 2021

(65) Prior Publication Data

US 2023/0064480 A1 Mar. 2, 2023

(30) Foreign Application Priority Data

Jan. 16, 2020 (DE) ..... 10 2020 200 510.9

(51) Int. Cl.
*B21D 39/03* (2006.01)
*B21C 47/24* (2006.01)

(52) U.S. Cl.
CPC ..... *B21D 39/034* (2013.01)

(58) Field of Classification Search
CPC .. B21D 39/031; B21D 39/034; B21D 39/035; B21D 37/04; B21D 37/14
USPC ..... 29/509, 514, 521, 243.5
See application file for complete search history.

(56) References Cited

U.S. PATENT DOCUMENTS

| | | | | |
|---|---|---|---|---|
| 3,114,151 | A | 12/1963 | Friedlander | |
| 3,670,398 | A | 6/1972 | Minton | |
| 4,391,037 | A | 7/1983 | Giasini | |
| 5,342,276 | A | 8/1994 | Fujiwara et al. | |
| 2004/0011456 | A1 | 1/2004 | Futamura et al. | |
| 2015/0121678 | A1* | 5/2015 | Noe | B21D 39/034 29/432 |
| 2015/0217358 | A1 | 8/2015 | Störmer et al. | |

FOREIGN PATENT DOCUMENTS

| | | | |
|---|---|---|---|
| DE | 668721 | C | 12/1938 |
| DE | 1962129 | A1 | 6/1971 |
| EP | 0029415 | A3 | 10/1981 |

(Continued)

OTHER PUBLICATIONS

English translate (JP2013035042A), retrieved date Aug. 30, 2023.*

*Primary Examiner* — Matthew Katcoff
*Assistant Examiner* — Mohammed S. Alawadi
(74) *Attorney, Agent, or Firm* — Smartpat PLC

(57) ABSTRACT

A stitcher (1) for connecting an end portion of an outgoing metal strip to a starting portion of an incoming metal strip for a continuously operated strip processing system comprises a first punching tool (20), which is designed to connect metal strips having a first thickness range and/or strength range to one another, and a second punching tool (30), which is designed to connect metal strips having a second thickness range and/or strength range to one another. Both thickness ranges and/or strength ranges are different from one another.

9 Claims, 2 Drawing Sheets

(56) References Cited

FOREIGN PATENT DOCUMENTS

| | | | | | |
|---|---|---|---|---|---|
| EP | 0455164 | A1 | | 11/1991 | |
| EP | 1504896 | B1 | | 12/2008 | |
| GB | 895889 | A | | 5/1962 | |
| JP | 2013035042 | A | * | 2/2013 | ..... B21C 47/247 |
| JP | 2013035042 | A | | 2/2013 | |
| WO | 2014033037 | A1 | | 3/2014 | |

* cited by examiner

STITCHER

TECHNICAL FIELD

The present disclosure relates to a stitcher for connecting an end portion of an outgoing metal strip to a starting portion of an incoming metal strip for a continuously operated strip processing system typically used in metal strip treatment or metal strip finishing operations. In an additional aspect, the present invention relates to a strip processing system comprising a stitcher along with a method for connecting an end portion of an outgoing metal strip to a starting portion of an incoming metal strip in a continuously operated strip processing system.

BACKGROUND

In continuously operated strip processing systems, strip joining systems serve to maintain the continuous strip run and connect the new metal strip to the outgoing metal strip in the inlet region of the strip processing system. Depending on the requirements of the metal strip, different connecting methods, such as clinching, gluing, welding or punching, can be used.

The most common strip joining systems employed in practice use punch connections, also known as stitching. Such stitchers have a single stitching tool built into the stitcher in single-row or double-row design. However, the problem with this type of punch connections is the fact that, as a rule, stitching can be used up to a metal strip thickness of 6 mm.

U.S. Pat. No. 3,114,151 discloses a stitcher with which an end portion of a first metal strip is connected to the starting portion of a second metal strip by means of a stitched seam. Thereby, both portions of the respective metal strips are initially overlapped. Subsequently, the thickness of the overlap region transverse to the longitudinal extent of the two metal strips is reduced to such an extent that connecting by means of the stitched seam is possible.

For larger thickness ranges of metal strips, the stitching tools have technologically unsuitable parameters, since they are typically designed for the minimum metal strip thicknesses to be stitched.

For example, in the case of aluminum strips in particular, it has been shown that a cutting process during stitching with blade gaps that are too narrow has a detrimental effect not only on the durability of the stitching tool, but also on the quality of the cutting edges during stitching. Particularly with aluminum strips, this leads to increased flaking in the region of the stitched seam. Such metal flakes are carried into the downstream process regions, where they have a negative impact on the product quality of the metal strips to be processed. Furthermore, the metal flakes settle on the rollers of the process line and result in increased maintenance effort.

SUMMARY

The present disclosure is based on the object of providing a stitcher which can be used for a larger thickness ranges and/or strength ranges without exhibiting the disadvantages known from the prior art. Further, it is an object of the present disclosure to provide an improved method for connecting an end portion of an outgoing metal strip to a starting portion of an incoming metal strip in a continuously operated strip processing system.

These objects are achieved by a stitcher along with a method as claimed and described.

The subclaims each relate to preferred embodiments or further developments of the present invention, the respective features of which can be freely combined with one another within the scope of what is technically expedient, if necessary also across the category boundaries of the various claims.

For connecting the end portion of an outgoing metal strip to the starting portion of an incoming metal strip, a stitcher for a continuously operated strip processing system, comprising a first punching tool and a second punching tool, is proposed. The first punching tool is designed to connect the metal strips to one another if their thicknesses are in a first thickness range and/or their strengths are in a first strength range. The second punching tool is designed to connect the metal strips to one another when their thicknesses are in a second thickness range and/or their strengths are in a second strength range, wherein both thickness ranges and/or strength ranges are different from one another.

Preferably, the first thickness range is 0.2 to 2.5 mm and the second thickness range is 2.0 to 3.5 mm.

Preferably, the first strength range is 20 MPa to 250 MPa for aluminum or an alloy thereof, and 100 MPa to 350 MPa for steel, and the second strength range is 200 MPa to 600 MPa for aluminum or an alloy thereof, and 300 MPa to 1000 MPa for steel.

In accordance with the method for connecting the end portion of an outgoing metal strip to the starting portion of an incoming metal strip in a continuously operated strip processing system, metal strips having a first thickness range and/or a first strength range are connected to one another with a first punching tool and metal strips having a second thickness range and/or a second strength range are connected to one another with a second punching tool, wherein both thickness ranges and/or strength ranges are different from one another.

Due to the two different punching tools, depending on the strip thicknesses and/or strip strengths of the metal strips to be stitched, the appropriate punching tool can be selected and used according to the connecting requirements. This not only has a positive effect on the quality of the cutting edges, but also protects the punching tool used accordingly.

Preferably, stitching is used as the connecting method. Stitching is a specific punching process with which a positive-locking connection of both metal strips is created by generating a punching geometry and a subsequent stretching. Connecting by means of stitch seams can advantageously be carried out in a single row or, more preferably, in a double row.

Preferably, the metal strips to be connected to one another are aluminum strips or steel strips.

In an advantageous embodiment, the first punching tool has a first punching pattern and the second punching tool has a second punching pattern, wherein both punching patterns are different from one another. The punching patterns are different punching geometries that are punched into the corresponding metal strip, for example aluminum or steel, by means of the punch and die. Due to the different punching patterns that the two punching tools have in each case, the punching tools can each be optimally designed for the respective metal strips, such that the stitcher can be used overall for a wider range of materials.

In an additional advantageous embodiment, it is provided that the first punching tool has a first cutting gap and the second punching tool has a second cutting gap that is different from the first cutting gap. This also has an advantageous effect on the usability of the stitcher, since the punching tools can thus be specifically designed for the range of materials to be stitched.

In principle, the tool change between the first and the second punching tool can be done manually.

Advantageously, however, the stitcher is designed in such a way that the tool change between the first and the second punching tool is fully automatic. This enables the tool change to be carried out while the strip is running. Therefore, the stopping of the entire strip processing line of the strip processing system is not necessary. In this connection, it is advantageously provided that both punching tools are arranged in one punching tool cassette. The punching tool cassette preferably can be displaced within the stitcher by means of a displacement device. For example, the stitcher has a motor and a toothed rack that interacts with the punching tool cassette and allows the tool to be changed quickly.

The punching tool cassette is arranged in the stitcher in such a way that one punching tool is arranged in a punching position and the other is arranged in a parking position. When a tool is changed, the punching tool in the punching position is exchanged for the other punching tool in stock by the displacement device of the stitcher displacing the punching tool cassette accordingly. The punching tool stored in the parking position is advantageously protected from damage by wear plates. Thus, the arrangement of the punching tools in a punching tool cassette enables an improved and faster tool change, such that the effort for the entire tool change process is reduced.

The tool change preferably takes place during ongoing strip operation between two stitch seams. Alternatively, the tool change can be carried out when the strip is at a standstill.

Furthermore, it is preferably provided that each of the punching tools is designed with blow-off by means of compressed air and/or tool lubrication.

An additional aspect of the present disclosure further relates to a strip processing system comprising the disclosed stitcher.

The invention and the technical environment are explained in more detail below with reference to the figures. It should be noted that the invention is not intended to be limited by the exemplary embodiments shown. In particular, unless explicitly shown otherwise, it is also possible to extract partial aspects of the facts explained in the figures and combine them with other components and findings from the present description and/or figures. In particular, it should be noted that the figures and in particular the size relationships shown are only schematically. Identical reference signs designate identical objects, such that explanations from other figures can be used as a supplement if necessary.

DETAILED DESCRIPTION

Figure 1:
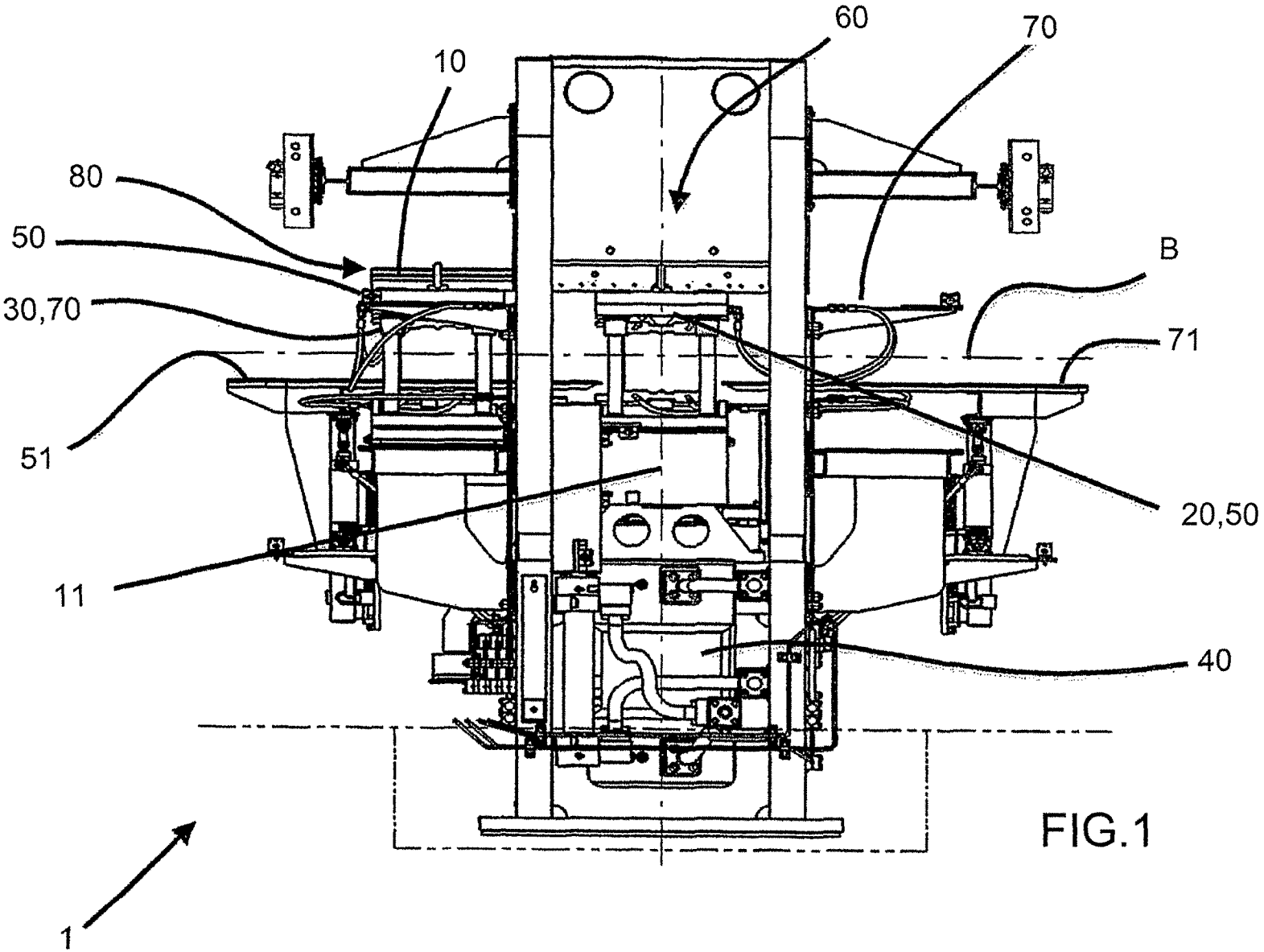
FIG. 1 is a side view of an embodiment of the stitcher.

FIG. 1 shows a stitcher 1 for connecting the end portion of an outgoing metal strip to the starting portion of an incoming metal strip for a continuously operated strip processing system, typically used in metal strip treatment or metal strip finishing operations. In the present illustration, the metal strips are not shown, only the strip run B is indicated.

The stitcher 1 comprises a first punching tool 20, which is designed to connect metal strips whose thicknesses lie in a first thickness range, preferably in the range from 0.2 to 2.5 mm, and a second punching tool 30, which is designed to connect metal strips whose thicknesses lie in a second thickness range, preferably from 2 to 3.5 mm, wherein both thickness ranges are different from one another.

In the present embodiment shown, the two punching tools 20, 30 are arranged in a punching tool cassette 80, which can be displaced within the stitcher 1 by means of a displacement device 60, such that the first punching tool 20 can be arranged in a punching position 50 and the second punching tool 30 can be arranged in a parking position 70 within the stitcher 1. For this purpose, the stitcher 1 has a motor (not shown) and a toothed rack 10 that interacts with the punching tool cassette 80 and allows the tools to be changed quickly.

To connect the two metal strips, stitching is used as the connecting method. For this purpose, each of the punching tools 20, 30 has a corresponding punch and die (not shown). Preferably, the punch and die of the first punching tool 20 are different from the second punching tool 30, that is, the first punching tool 20 has a first punching pattern and the second punching tool has a second punching pattern. In addition or alternatively, the punches and the dies of the respective punching tools 20, 30 also have different cutting gaps.

The respective punching tool 20, 30 located in the punching position 50 is hydraulically operated in the present embodiment shown of the stitcher 1. For this purpose, the stitcher 1 comprises a hydraulic unit 40, which is arranged in the lower part of the stitcher 1.

In the embodiment shown, the first punching tool 20 is arranged in the punching position 50 within the stitcher 1. Accordingly, the second punching tool 30 is arranged in a parking position in the punching tool cassette 80 on the strip inlet side and outside the stitcher 1 and is protected from possible damage by means of a wear plate 51.

For a tool change between the first and second punching tools 20, 30, the displacement device 60 is provided; this allows a fully automatic tool change. The tool change can preferably be carried out during ongoing strip operation between two stitched seams or when the strip is at a standstill.

In the present embodiment, the first punching tool 20 is moved out of the punching position 50 and into the parking position during a tool change. For this purpose, the punching tool cassette 80 is displaced by means of the displacement device 60 to such an extent that the first punching tool 20 is arranged on the strip outlet side, while the second punching tool 30 reaches the punching position 50. A wear plate 71 is also provided on the strip outlet side to protect the first punching tool 20 from possible damage.

In an alternative embodiment, the first punching tool 20 is designed to connect the metal strips to one another if their strengths are in a first strength range, wherein the second punching tool 30 is then designed to connect the metal strips to one another if their strengths are in a second strength range, wherein both strength ranges are different from one another. For aluminum, for example, the first strength range can comprise 20 MPa to 250 MPa and the second strength range can comprise 200 MPa to 600 MPa. For steel, on the other hand, the first strength range can comprise, for example, 100 MPa to 350 MPa and the second strength range can comprise 300 MPa to 1000 MPa.

Figure 2:
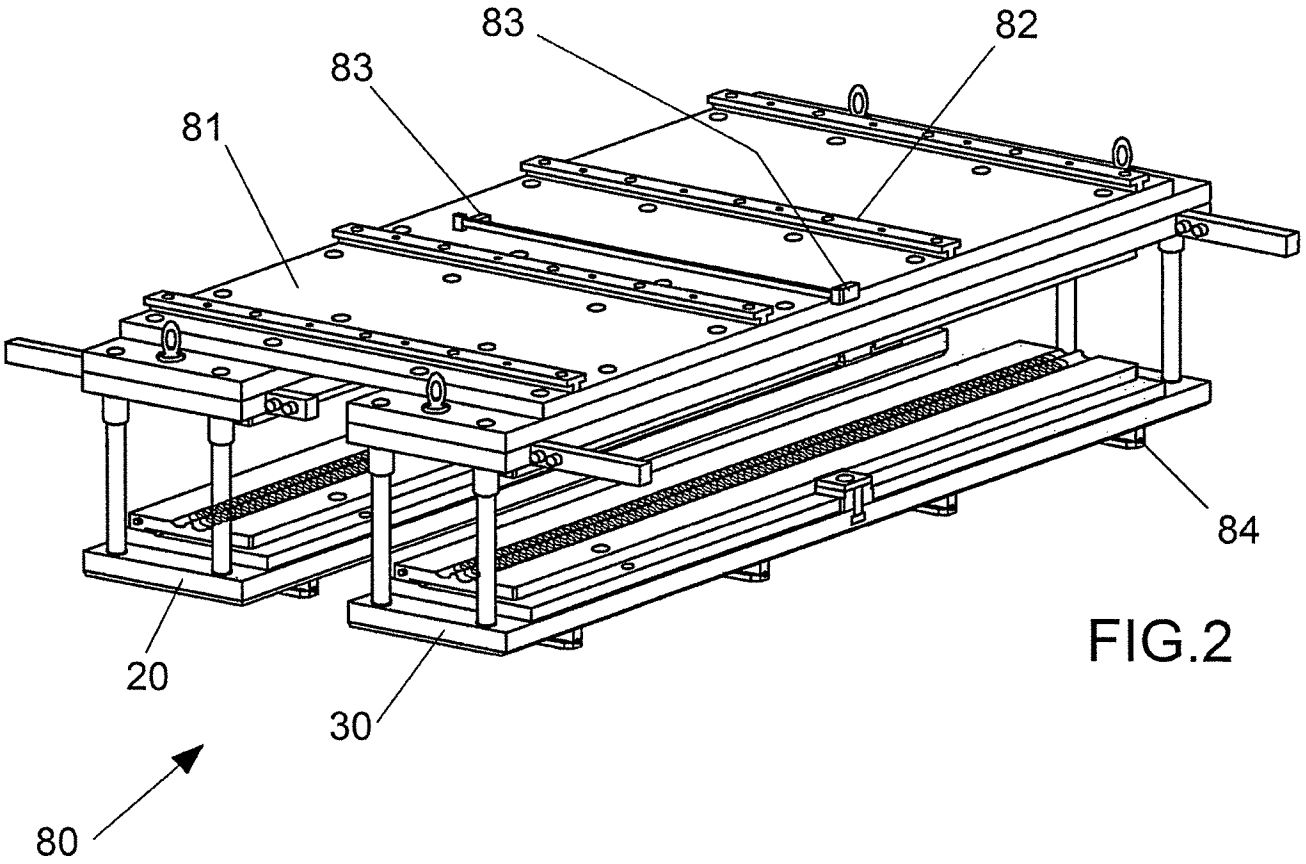
FIG. 2 shows an embodiment of a punching tool cassette.

FIG. 2 shows one embodiment of the punching tool cassette 80. This comprises a cover plate 81, to which a plurality of T-bars 82 is fastened. By means of the T-bars 82, the punching tool cassette 80 is held in the stitcher 1 and is moved via the toothed rack 10 (FIG. 1). Via stop elements 83 arranged on the cover plate 81, the punching tool cassette 80 is moved to the correct end position, which is sensed by a limit switch (not shown). The two punching tools 20, 30 are fastened below the cover plate 81. As shown, each of the punching dies 20, 30 comprises a plurality of runners 84 that thread into a lifting ram 11 (FIG. 1), for example when the punching tool cassette 80 is moved. If the lower tool part of the respective punching tool 20, 30 does not follow the force of gravity when lowering the lifting ram 11 after a stitching process, such connection pulls the lower tool part back to the lower end position by the lifting ram 11.

REFERENCE SIGNS

1 Stitcher
10 Toothed rack
11 Lifting ram
20 First punching tool
30 Second punching tool
40 Hydraulic unit
50 Punching position
51 Wear plate
60 Displacement device
70 Parking position
71 Wear plate
80 Punching tool cassette
81 Cover plate
82 T-bars
83 Stop element
84 Runners
B Strip run

The invention claimed is:

1. A stitcher (1) for connecting an end portion of an outgoing metal strip to a starting portion of an incoming metal strip for a continuously operated strip processing system, comprising:

a punching tool cassette (80), including a cover plate (81), a first punching tool (20) fastened to the cover plate (81), the first punching tool (20) being designed to connect the metal strips to one another if their thicknesses are in a first thickness range and/or if their strengths are in a first strength range, and a second punching tool (30) fastened to the cover plate (81), the second punching tool (30) being designed to connect the metal strips to one another if their thicknesses are in a second thickness range and/or their strengths are in a second strength range, wherein both thickness ranges and/or strength ranges are different from one another, and wherein, in a first configuration, the second punching tool (30) is arranged in a parking position on a strip inlet side of the stitcher while the first punching tool (20) is arranged in a punching position, and wherein, in a second configuration, the second punching tool (30) is arranged in the punching position while the first punching tool (20) is arranged in a parking position on a strip outlet side of the stitcher, wherein the first punching tool (20) and the second punching tool (30) each comprises a plurality of runners (84) that thread into a lifting ram (11) when the respective punching tool (20,30) is in the punching position, and wherein the lifting ram (11) pulls a lower tool part of the respective first punching tool (20) or second punching tool (30) to a lower end position in case the lower tool part does not follow a force of gravity when lowering the lifting ram (11).

2. The stitcher (1) according to claim 1, wherein the first thickness range is 0.2 to 2.5 mm and the second thickness range is 2.0 to 3.5 mm.

3. The stitcher (1) according to claim 1, wherein the first strength range is 20 MPa to 250 MPa for aluminum and 100 MPa to 350 MPa for steel and wherein the second strength range is 200 MPa to 600 MPa for aluminum and 300 MPa to 1000 MPa for steel.

4. The stitcher (1) according to claim 1, wherein the first punching tool (20) has a first punching pattern and the second punching tool (30) has a second punching pattern, wherein both punching patterns are different from one another.

5. The stitcher (1) according to claim 1, wherein the first punching tool (20) has a first cutting gap and the second punching tool (30) has a second cutting gap that is different from the first cutting gap.

6. A strip processing system comprising the stitcher (1) according to claim 1.

7. The stitcher (1) according to claim 1, wherein the punching tool cassette (80) is held in the stitcher (1) by a plurality of T-bars (82) that are fastened to an upper side of the cover plate (81), and wherein the first punching tool (20) and the second punching tool (30) are fastened below the cover plate (81).

8. The stitcher (1) according to claim 7, wherein stop element (83) are arranged on the cover plate (81), and wherein the punching tools cassette (80) is moved via a toothed rack (10) by a displacement device (60).

9. The stitcher (1) according to claim 1, further comprising an inlet-side wear plate (51) for protecting the second punching tool (3)) while it is arranged in the parking position on the strip inlet side of the stitcher, and an outlet-side plate (71) for protecting the first punching tool (20) while it is arranged in the parking position on the strip outlet side of the stitcher.

* * * * *